United States Patent [19]

Stollenwerk et al.

[11] 4,033,253

[45] July 5, 1977

[54] FRUIT PRESS

[76] Inventors: Hubert C. Stollenwerk, P. O. Box 242; Hubert F. Stollenwerk, R.R. 3, Box 82, both of Egg Harbor, N.J. 08215

[22] Filed: Aug. 27, 1975

[21] Appl. No.: 608,049

[52] U.S. Cl. ..... 100/118; 100/127; 100/151; 100/222

[51] Int. Cl.[2] ..... B30B 9/04; B30B 9/24

[58] Field of Search ..... 100/116, 118–120, 100/151–154, 126–129, 222, 246, 253; 425/84, 353

[56] References Cited

UNITED STATES PATENTS

| | | | |
|---|---|---|---|
| 679,463 | 7/1901 | Long | 100/122 X |
| 1,738,326 | 12/1929 | Smith | 100/116 |
| 1,767,054 | 6/1930 | Briggs | 100/122 X |
| 2,613,592 | 10/1952 | Nemir | 100/127 X |
| 3,063,362 | 11/1962 | Guettler | 100/118 X |
| 3,232,219 | 2/1966 | Gunkel | 100/222 X |

FOREIGN PATENTS OR APPLICATIONS

| | | | |
|---|---|---|---|
| 217,462 | 9/1958 | Australia | 100/118 |
| 29,353 | 8/1910 | Sweden | 100/222 |

*Primary Examiner*—Peter Feldman
*Attorney, Agent, or Firm*—James A. Drobile; Robert S. Bramson

[57] ABSTRACT

Fruit press comprising an endless conveyor belt for transporting the fruit or other material to be dewatered or dejuiced, the belt being driven in a horizontal direction, one or more hydraulic platens for compressing the fruit or other liquid-containing compressable material for dejuicing, dewatering, or deoiling the same, as the case may be, movable, permeable sides associated with each platen to contain the sides of the cake being pressed by the platen and vertically movable gates upstream and downstream of each platen to contain the cake being pressed.

9 Claims, 10 Drawing Figures

FRUIT PRESS

BACKGROUND OF THE INVENTION

1. Field of the Invention

The invention relates to fruit presses which operate to dejuice, dewater or deoil fruits and other liquid-containing materials, such as grapes, apples, crabapples, berries, cherries, olives, pineapples, hops and other herbs, spent grain, sludges, such as sewage sludges, and oil seeds, such as olive oil seeds, cotton seeds, sesame seeds, peanuts, linseeds and the like.

2. State of the Art

Numerous machines have been designed and utilized for the purpose of dejuicing, dewatering and deoiling fruits and other materials, and most usually for dejuicing such fruits as apples, grapes, pears and the like. A number of different types of presses for this purpose have been developed, and a typical such device includes a plurality of horizontally extending platens, operated by suitable hydraulic systems which compress the fruit against a table, the fruit being contained in a specially designed "press cloth," which typically has an open top, and has a closed, permeable bottom and sides for the purpose of containing the fruit. One of the factors limiting the amount of fruit that can be handled in a given size of machine is the final thickness of the fruit cake, because a final cake thickness exceeding a predetermined amount, typically about two inches, will result in expression of the fruit pulp out of the press cloth. It is, therefore, highly desirable to be able to introduce into a given size of dewatering press a substantially greater quantity of fruit or other material than has heretofore been possible, thereby substantially increasing the production capacity of a given size of machine. Obviously, if a conventional fruit press can only compress to a final cake thickness of two inches, a press capable of compressing the same material to a final cake thickness of eight inches will effectively quadruple the production capacity of the press, for a given size of press and other substantially constant conditions of operation.

U.S. Pat. No. 220,249 discloses the use of a foldedover top press cloth for the purpose of preventing escape of the "pomace" about the edges of the press cloth. U.S. Pat. Nos. 255,896, 271,387, and 1,457,755 are also directed to presses utilizing folded over press cloths. However, it has been determined that the folding over of the press cloth to prevent expression of the fruit or pulp out of the press cloth is not satisfactory to permit operation of a press cloth witout such losses, at least under the quantities, pressures and rates of throughput utilized in modern fruit presses.

There is not known to exist any fruit press which is capable of compressing fruits or other materials in thicknesses of final cakes of up to about 12 inches, without any significant spill-out. For example, a conventional horizontal platen machine having platens of square shape with 36 inch faces, would normally produce a final press cake of 2 inches in thickness. The utilization, in the same type of machine, of the apparatus or process of this invention, allows final press cakes of up to 12 inches in thickness to be produced, thereby multiplying, by up to a factor of six, the throughput of the machine.

BRIEF SUMMARY OF THE INVENTION

Apparatus for expressing or expelling a liquid from fruits, such as apples, sugar beets, grapes, and the like, or for extracting water or oil from such products as waste sludges or oil seeds, and utilizing a plurality of horizontal, hydraulically operated platens, for expressing the fluid by compressing the fruit.

The fruit (or other material being dewatered, dejuiced or deoiled) is conveyed to the apparatus of the invention by being deposited in a suitable open-fronted basket mounted on the conveyor belt. The fruit, discharged from the basket, is then indexed, in successive stages, beneath one or more platens, preferably a plurality of platens, which compress the fruit (or other material) against the underlying, supported conveyor belt. The conveyor belt is suitably supported by a table to withstand the substantial downward pressure of the platens. The platen area is formed wit rigid, permeable sides, which may be composed of spaced metal slats, which are moveable in small increments, toward and from the fruit mass being pressed and are covered by suitable screens.

On the upstream and downstream side of each platen is a rigid gate, which is capable of being lowered to a point adjacent to the conveyor belt and subsequently being raised to a point just above the upper edge of the final press cakes being formed. When the pressing operation is about to begin, the sides move inwardly to support the cake during the pressing operation and the gates are lowered, so that the cake is fully supported on two vertical faces by the sides, on the other two vertical faces by the gates, and on the bottom by the endless conveyor belt, and is then compressed downwardly by the platen to express juice which exits through the screens and spaces between the slats forming the sides, through suitable apertures and spaces in the endless conveyor belt, and, if desired, through apertures in the gates.

The pressure surface of each platen may, but need not, be formed with a plurality of grooves extending transverse to the direction of movement of the cake. If such grooves are used, the pressure surface of each platen would be covered by a rigid screen, to prevent mash clogging the grooves and thereby to permit dejuicing or dewatering of the upper surface of the cake being compressed through the screen and grooves. If two or more platens are used, the area covered by the grooves in the platens is substantially smaller in the higher pressure platens than is the case in the lower pressure platens. If two or more platens are used, the higher pressure platens are downstream of the lower pressure platens.

The platens may be slightly tapered, whereby each platen is slightly wider at its downstream end than at its upstream end, to facilitate the incremental movement, without jamming, of the press cake on the conveyor belt. The moveability of the sides is also utilized to prevent jamming and facilitate the feed of the cake.

The slats which form the sides are covered with rigid screen material and have a staggered spacing, whereby the slats at the bottom of the sides are closer together than the slats at the top of the sides, in order to permit the expression of juice or other liquid without expressing solid cake material from the sides.

In one embodiment of the invention, a conventional type of filter cloth may overlie the cake as it passes beneath the platen press area.

It is to be noted that, although the invention is described wit respect to fruit, it may be used with respect to vegetables, sludges, oil seeds, herbs, and any other substance or material which is compressible and contains a substantial amount of liquid desired to be separated from a mass of solid or semi-solid, viscous material. It will be appreciated that, since different materials contain different relative amounts of solid and liquid (i.e. juice, oil or the like) different degrees of cake compression will be necessary or desirable to express an economic quantity of liquid.

In a preferable form of the invention, the conveyor belt device is of the flat chain type, which consists of a plurality of transversely extending slats, formed of metal, and spaced by a relatively small space of approximately one-sixteenth inch.

In the process of the invention, fruit or other material to be dejuiced, deoiled or dewatered is enclosed on its sides by rigid permeable sides and rigid gates which, together with the rigidly supported conveyor belt and platen, completely envelop the fruit, (or other material) to provide a completely closed enclosure for the fruit (or other material) as the fruit is compressed in the platen section of the machine. The fruit (or other material) is introduced into the platen section in a quantity intended to produce a final press cake of up to about twelve inches, it being understood that the final press cake thickness will depend in part, on the particular material being treated (e.g. apples, linseeds), its condition (e.g. partially dejuiced, overripe, etc.) and on the size of machine being used.

OBJECT OF THE INVENTION

It is therefore an object of this invention to provide an automatic press apparatus capable of producing a press cake of up to six times the size of the press cake capable of being produced by prior apparatus and processes, thereby processing up to six times the quantity of fruits, herbs, vegetables, seeds, sludges or other material otherwise capable of being handled by a given size of machine.

Another object of this invention is to provide a dewatering, dejuicing and deoiling press capable of handling up to six times the capacity of a substantially similar fruit press not embodying the principles of this invention.

Yet another object of this invention is to provide a fruit press having rigid, permeable sides on either side of the platen section and rigid gates on the upstream and downstream sides of each platen, whereby the sides, gates, the underlying conveyor means and overlying platen completely envelop the cake being pressed.

A further object of this invention is to provide a press apparatus utilizing transversely grooved platen surfaces to deliver liquid expressed from the upper surface of the cakes to the edges of the machine where it is drained and collected.

Still another object of the invention is to provide design of rigid, permeable sides of a fruit press machine which permits expression or expulsion of liquid from the sides without expression of any pulp material.

A concomitant object of this invention is to provide a dewatering, deoiling or dejuicing fruit, vegetables, herbs, oil seeds, sludges and other materials in which the material is compressed by one or more platens and, at the time of compressing, is rigidly supported on each side of its periphery.

DETAILED DESCRIPTION OF THE INVENTION

Figure 1:
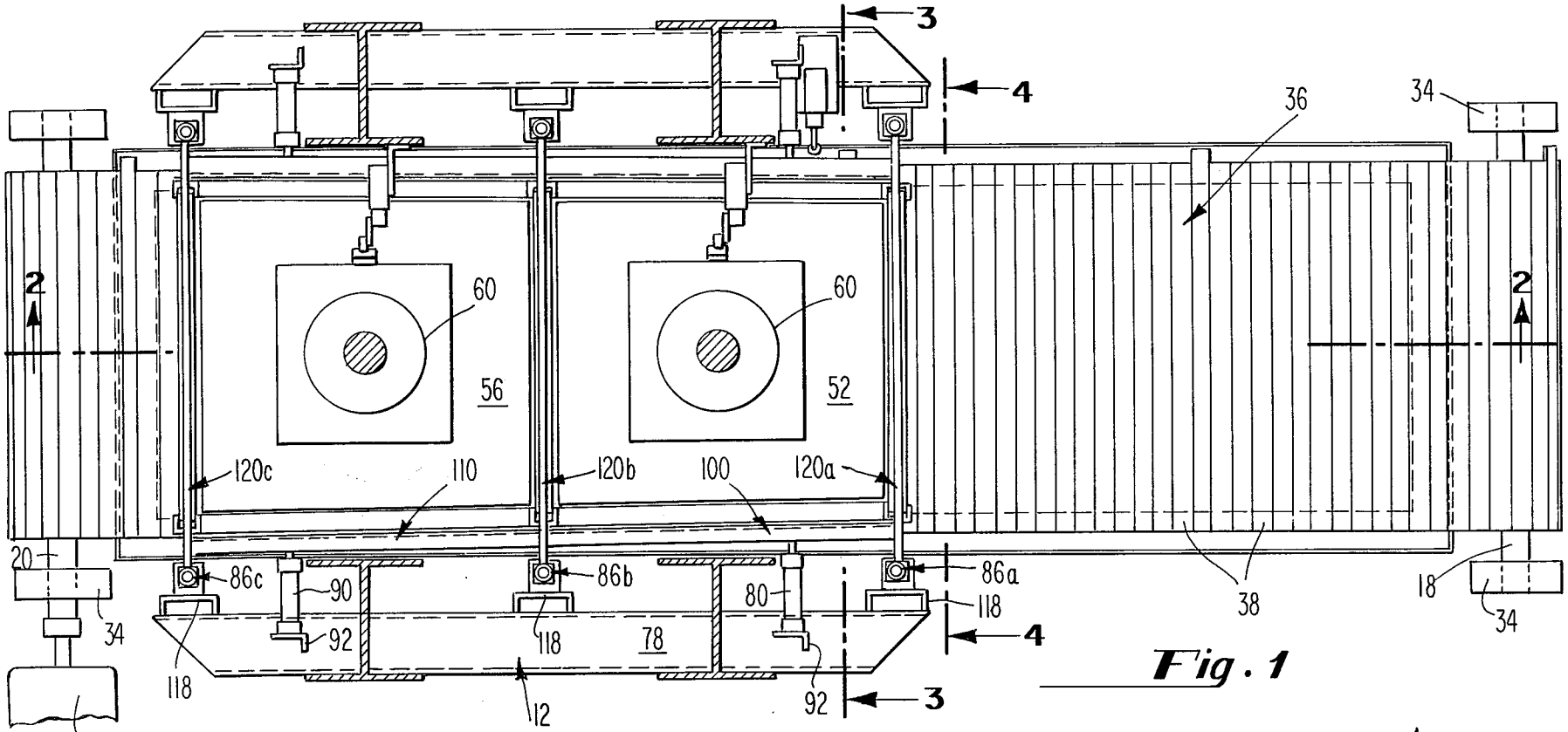
FIG. 1 is a top plan view, partially in cross-section, of a press embodying the principles of this invention.
Figure 2:
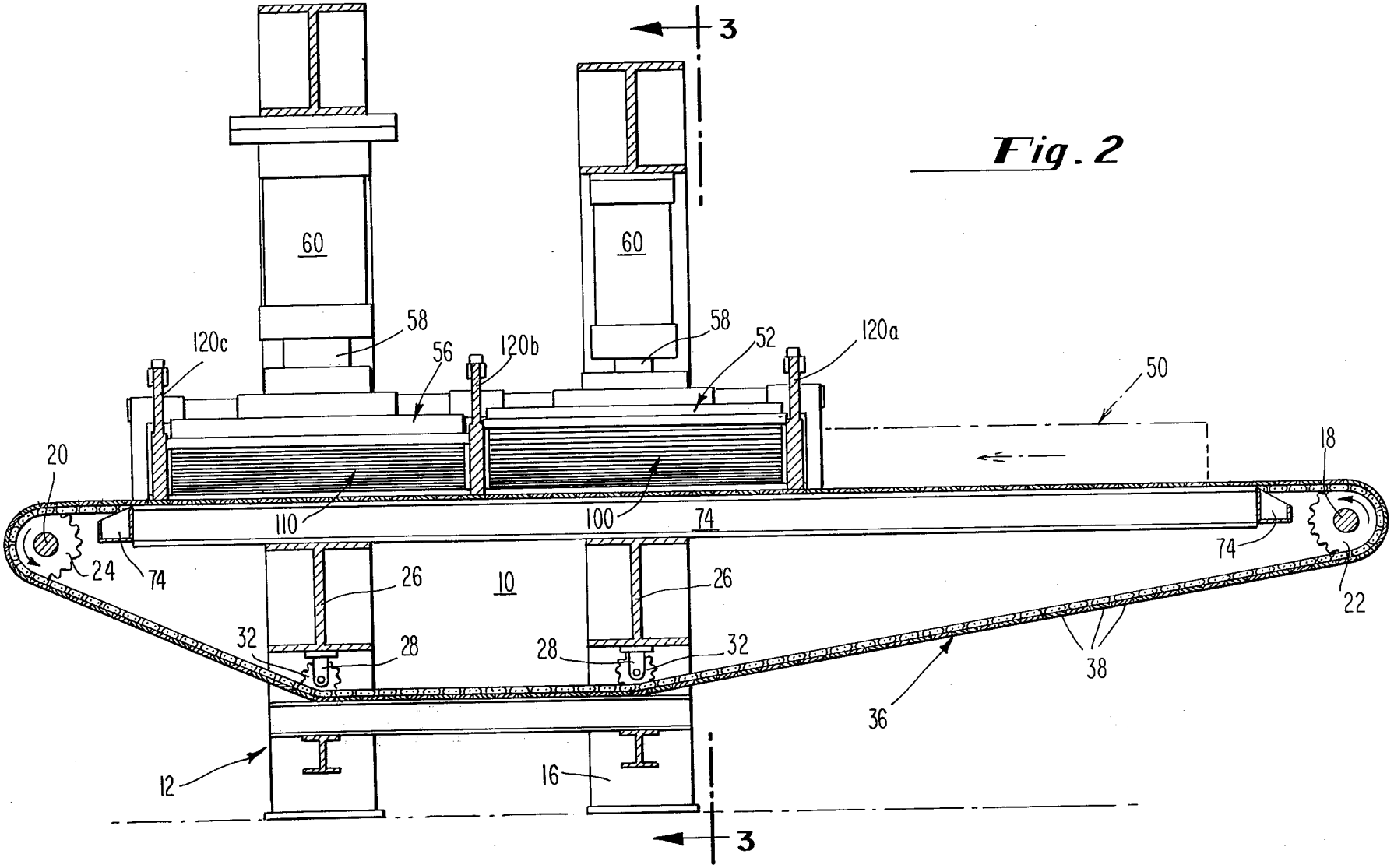
FIG. 2 is a cross-sectional view, taken along line 2—2 of FIG. 1.

Viewing FIG. 2, the fruit press, generally designated by numeral 10, is seen to comprise a frame generally designated by numeral 12, having journal sections 34 (seen in FIG. 1) and supported upon legs generally designated by numeral 16. The overall configuration of the frame is of conventional design, and is well-known to those skilled in the art in connection with horizontal multiple platen fruit press machines.

Rotatably mounted in the journal sections 34 at the input end of the machine is shaft 18, which has rigidly fastened proximate each end thereof a sprocket 22.

Rotatably mounted in journal sections 34 at the output end of the machine (the left-hand side in FIGS. 1 and 2) is a shaft 20, having a pair of sprockets 24 rigidly mounted proximate its ends. The sprockets 22 and 24 may be identical.

As best seen in FIG. 2, the frame 10 includes horizontally extending frame members 26, each of which dependingly supports a pair of bracket members 28, which rotatably mount idler sprockets 32, which engage the chains 40 on the sides of conveyor belt 36.

The endless conveyor 36 is comprised of a plurality of trapezoidal stainless steel slats 38, each of which is approximately 2 inches long and 38 inches wide, and having an upper face which is slightly longer than its lower face to facilitate drainage of juice or other liquid. The ends of the individual slats 38 are fastened on one side of the machine to chains 40 and at their other end to identical chains 40 (not shown). This slat construction is easily cleaned and also accomplishes some gravity cleaning of mash incorporated in the spaces between the slats when the conveyor changes direction at the ends of the machine. This cleaning is also facilitated by the trapezoidal shape of the slats which increase the prospect of material between slats falling away. The mounting of the slats upon the chains is achieved by riveting or similarly fastening one chain segment to a slat, on each side, thereby allowing the chains and the slats to comprise an endless conveyor 36 which is capable of being transported about the sprockets 22 and 24 and idlers 32. The chains 40 are of such size and shape that they are engaged by the sprockets 24, drivingly to advance the conveyor 36 in a counter-clockwise direction (viewing FIG. 2), the links 40 of conveyor 36 passing over the idler sprockets 28, all of which are rotatably mounted. Shaft 20 is drivingly mounted by a suitable drive motor 42 which is appropriately mounted on the machine frame (the mounting is not shown).

The purpose of the conveyor belt 36 is to advance and provide support for the pomace (a pomace is a mass of fruit pieces to be dejuiced) as it advances through the machine, and particularly as it is pressed in the platen section, while permitting juice to drain through the spacing between slats, without allowing pulp to be expressed between the slats.

The spacing between the individual slats 38 is important in the practice of the invention, because too close spacing will not allow adequate drainage of juice and too great spacing will cause the platens to force the pomace down into the spaces between slats during the compressing operation, and this can result in expressing pulp with the juice expressed from the pomace. Most desirably, the spacing between the upper faces of the individual slats is about 1/16 of an inch.

Located on top of the conveyor belt, and rigidly mounted on the frame, is a four-sides, bottomless and topless perforated metal basket 50, shown in phantom in FIG. 2, and which acts as a receptacle into which the pomace is initially fed from the feed hopper. Three sides of the basket are closed and the fourth side, at the downstream end, is open and comprises a vertically adjustable, horizontally extending slat (not shown). The downstream end of basket 50 has the vertically adjustable metal slat (not shown) mounted thereon and spaced a variable distance above the conveyor 36 to determine the height of the mash fed to the platens. Desirably, the basket has a length (in the machine direction) of about 1½ times the length of the incremental movement of the belt 36 to feed the platen section. By the raising or lowering of the metal slat at the downstream end of basket 50 to the desired level of introduction of material, the level of the material introduced into the platen section for dewatering, dejuicing or deoiling can be controlled.

The platen section of the fruit press preferably comprises two platens, each of which conventionally has a square compressing face, each side of which is 36 inches long. The low pressure platen is designated 52 and the high pressure platen is designated 56. Each platen is supported by a suitable piston 58 which is conventionally a hydraulic piston and is supplied with hydraulic fluid by a suitable hydraulic cylinder 60 mounted on the machine frame, as illustrated in FIG. 2, in order to provide adequate downward force for the platens to compress the material being deliquified. Although only two platens are illustrated in the drawings, it is conventional for a machine to have three, four or more platens, and the particular number of platens utilized may be varied. It is desirable to have at least two platens for the machine, operating sequentially, with a high pressure platen being downstream of the low pressure platen. If a single platen were used the wet mash entering the platen stage would be in contact with the "dry" press cake exiting the platen stage and a certain amount of "wicking" of juice or other liquid from the wet mass to the dry cake would occur, with an attendant loss of yield. Use of an intermediate "dryness" mass to be pressed at the second platen minimizes the wicking problem, since about eighty to ninety percent of the liquid in the wet mass is removed at the low pressure platen. Approximately ten percent of the original liquid in the uncompressed mass is removed at the high pressure platen.

Although it is desirable to use a low pressure compression stage and a high pressure compression stage, the capacity of the machine may be increased by using more than one platen per stage. Thus, if it is desired to double machine capacity, it would be preferable to use two 36 by 36 inch platens in each of the low pressure and high pressure stages, rather than one platen 36 by 72 inches in dimension for each stage. The use of more, smaller platens is occasioned by the desirability of using more, smaller hydraulic cylinders to operate the platens, providing greater economy of operation and longer cylinder life.

Figure 9:
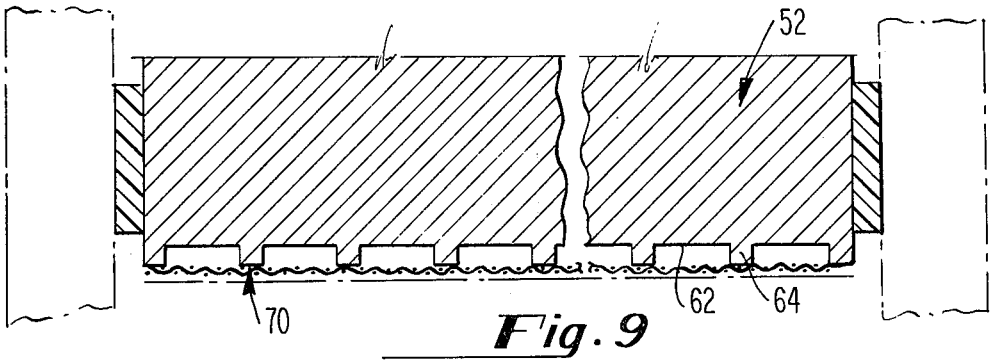
FIG. 9 is a cross-sectional view, taken in the machine direction, of the low pressure platen.
Figure 10:
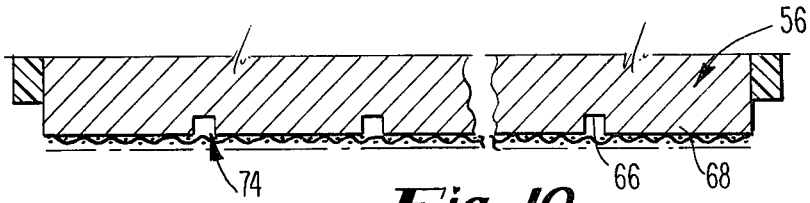
FIG. 10 is a cross-sectional view, taken in the machine direction, of the high pressure platen.

The downward displacement of each platen is controlled so that the extent of the compression of the fruit or other material increases with each platen in the downstream direction. The first platen 52, at the upstream end of the machine, compresses the material to form a press cake and express up to 80 or 90% of the recoverable liquid in the material being handled. The downstream, high pressure platen 56 would express up to about ten percent of the recoverable liquid. Viewing FIGS. 9 and 10, the platens 52 and 56 may be desirably provided with suitable transversely extending grooves on their lower faces, in order to permit and facilitate expression and drainage of juices from the upper surface of the mass being pressed. The grooves 62 and 66 may, if desired, be defined by bars of rectangular stainless steel bar stock, welded or screwed to the platen or, if a thick platen is utilized, could be grooved into the platen with a milling machine. The grooves 62 on the low pressure platen may, for example, be formed of ½ inch square bar stock with 2 inch spacing between proximate bars. The grooves 62 in the low pressure platen 52 are formed by the depending members 64 which may be formed in the illustrated platen by milling. Because most of the liquid is removed at the upstream platen 52, it may be desired to groove that platen only, to facilitate drainage.

The high pressure platen 66 is also formed with transversely extending grooves, designated by number 66, the grooves in the high pressure platen 56 being only approximately ½ inch wide, and the grooves in the low pressure platen 52 being 1 inch wide. The depending portions of the high pressure platen are designated by number 68.

If grooved platens are to be used, a stainless steel screen 70 should be fastened to the platen by welding or by suitable machine screws (not shown). The purpose of the screens, which are formed of stainless steel, if a food product is pressed, and are fairly rigid, is to prevent the pomace from being forced upward into and clogging the respective grooves 62 and 66.

Figure 3:
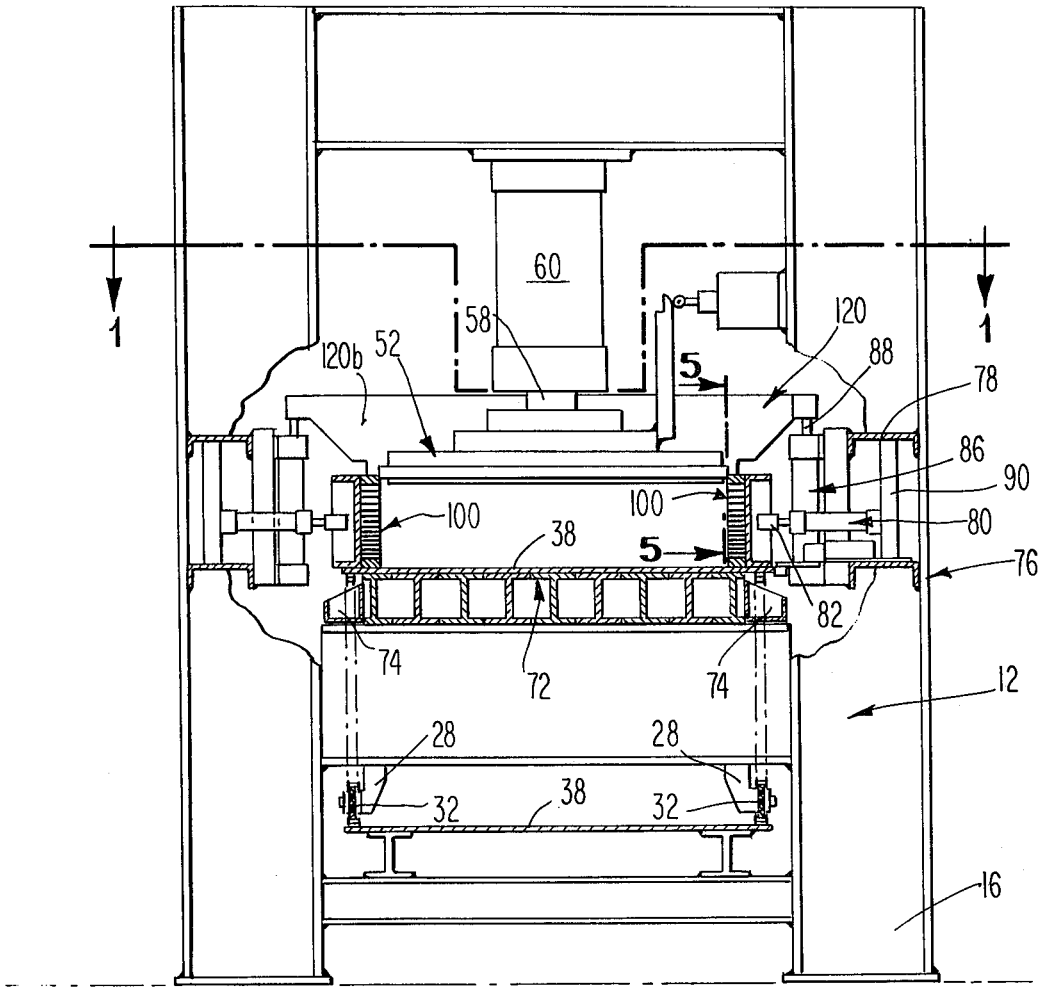
FIG. 3 is a partial cross-sectional view, taken along line 3—3 of FIG. 1.

Located between the upper and lower portions of the conveyor 36 and spaced proximate the upper portion thereof, is a support table 72 (best seen in FIG. 3). The table 72 is slightly narrower than the distance between the pairs of chains 40 of the conveyor 36. The table 72 comprises an horizontal stainless steel planar surface, suitably supported, in a manner well-known to the art, by the press frame 12, and extending from just upstream of the upstream end of basket 50 to a point just downstream of the last platen. The table is required in order to provide a rigid surface against which the platens 52 and 56 can compress the fruit or other material being dejuiced, deoiled or dewatered. Located along the outer edges of the table 72 are troughs 74, into which the juice or other liquid being expressed flows from the table top, which troughs are provided with suitable outlets (not shown) in a manner well-known in the art, for the purpose of transporting the juice or other expressed liquid to a suitable storage means.

As seen in FIG. 3, mounted on each side of table 72 to machine frame 12 is an horizontal support member 78, the purpose of which is to support the hydraulic cylinder assemblies which move the moveable side members 100 and 110 and the moveable gate members 120*a*, 120*b* and 120*c*. Support beam 78 is mounted on vertical beam 76 as seen in FIG. 3, and three or more horizontally extending hydraulic cylinders 80 are mounted on either side of the machine of this invention, by having the bases of the cylinders mounted, as by welding, to the vertical plate 92. There are, therefore, four horizontally extending hydraulic cylinders, respectively the two opposing hydraulic cylinders 80 which are mounted to the opposing low pressure platen side sections 100, and the two opposing hydraulic cylinders 90 which are mounted to the opposing high pressure platen side sections 110.

Figure 7:
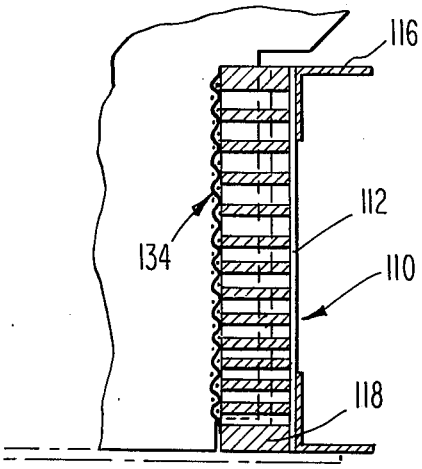
FIG. 7 is a cross-sectional view of the side of this invention, along the high pressure platen side.
Figure 6:
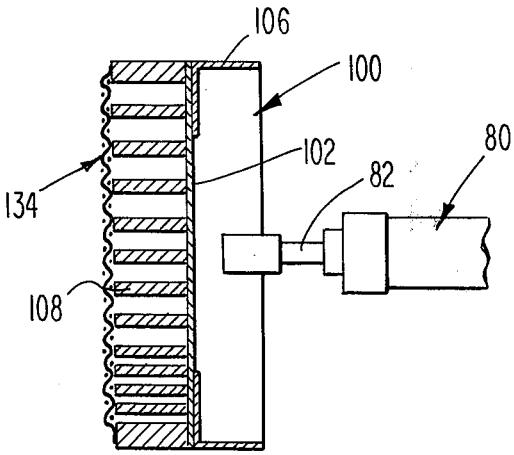
FIG. 6 is a cross-sectional view of the side of this invention, along the low pressure platen side.

As seen in FIGS. 6 and 7, each of the side sections, which form an integral single unit, is formed by vertically extending backing plates 102 annd 112, respectively, to which there are fastened, as by welding, L-shaped backing brackets 106 and 116, respectively, on one side, and to which there is fastened, as by welding, on the other side, the metal slats 108 and 118, respectively. For example, side section 100, of which there are two, one on either side of the low pressure platen, is formed with vertically extending, horizontally spaced backing plates 102, to which there are fastened, as by welding, upper and lower L-shaped support members 106. Welded to the other side of plate 102 are the individual slats 108 which form the side. The piston member of an hydraulic cylinder assembly 80 is welded to each side section 100 and the piston of an hydraulic cylinder 90 is welded to each side section 110. The individual slats 108 and 118 are formed of stainless steel rectangular bar stock, which is desirably ¼ inch wide by 1¾ inches deep. The lowermost and uppermost slat members 108 and 118 are preferably ¾ inch wide.

It is to be noted that the spacing between the slats for the low pressure platen is approximately ⅝ inch vertical spacing between the upper slats, approximately ½ inch vertical spacing between middle slats, and approximately 3/16 inch spacing between the lower slats.

The slats for the sides of the high pressure platen are spaced about ½ inch apart for the upper slats, about ⅜ inch apart for the intermediate slats and ¼ apart for the lower slats.

The slat sections 110 of each side of the high pressure platen may be solid, rather than slatted, to serve to contain the sides of the mass being compressed in the high pressure platen section. In this embodiment all of the liquid expressed in the high pressure platen area drains through the conveyor 36 to table 72 for recovery.

Each of the slatted side sections is covered at its inner face with a stainless steel screen 134 brazed or otherwise suitably fastened thereto to prevent expression of mash between the slats. The mesh size of the screen may vary, depending upon the material being pressed and the pressures utilized. However, for pressing applies a suitable mesh size is 0.040 × ¾ inch slots mesh.

It is to be noted that, if the apparatus of the invention is to be used for processing food products, such as fruit or vegetable juices, all parts which come in contact with the fruit or juice must be formed of food grade stainless steel.

Figure 5:
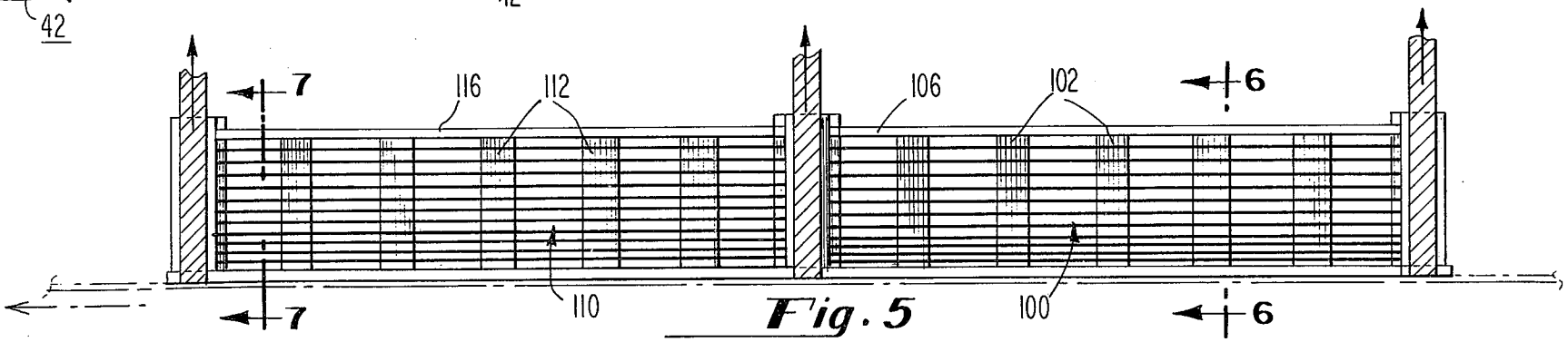
FIG. 5 is a cross-sectional view, taken along line 5—5 of FIG. 3.

Viewing FIG. 5, the side sections will then be seen to comprise a series of horizontally extending slats, with vertical spaces between them, and with staggered backing members 102 which support the slats. It will be noted both in FIG. 6 and in FIG. 7 that the slats 108 and 118 are staggered, so that the slats near the top are farther apart than the slats near the bottom. The reason for this is because the pressure at the bottom of the cake is higher than the pressure at the top of the cake and the closer spacing is necessary to prevent the screen 134 from being pressed between the slats and being damaged.

Viewing FIG. 1, mounted on each beam member 78 of the machine frame 12 are three spaced bracket members 118 on which there is mounted, as by welding, one of the vertically extending hydraulic cylinder assemblies, respectively designated 86*a*, 86*b* and 86*c*. The hydraulic cylinder assemblies come in pairs, one on either side of the table 72, and assembly 86*a* operates the low pressure gate, 86*b* operates the intermediate gate and 86*c* operates the high pressure gate. The respective low pressure, intermediate and high pressure gates are designated by numerals 120*a*, 120*b* and 120*c* and each comprises a single piece of stainless steel approximately 2 inches thick. Each gate has a lower edge, 124*a*, 124*b* and 124*c*, respectively, and an upper edge, 126*a*, 126*b* and 126*c*, respectively. The gates and hydraulic assemblies are best seen in FIG. 4, which shows that the piston 88 of each of the hydraulic cylinder assemblies 86 is fastened to the corresponding end of the gate 120, so that the gates raise and lower by the respective pairs of hydraulic cylinder assemblies 86*a*, 86*b* and 86*c*.

The purpose of the hydraulic assemblies 86 to raise and lower the respective gates is to permit the gates to be raised and then lowered between pressing cycles, in order to confine the cake being pressed during the pressing operation and to permit conveyor 36 to advance and to move the press cake downstream between pressing steps.

Figure 4:
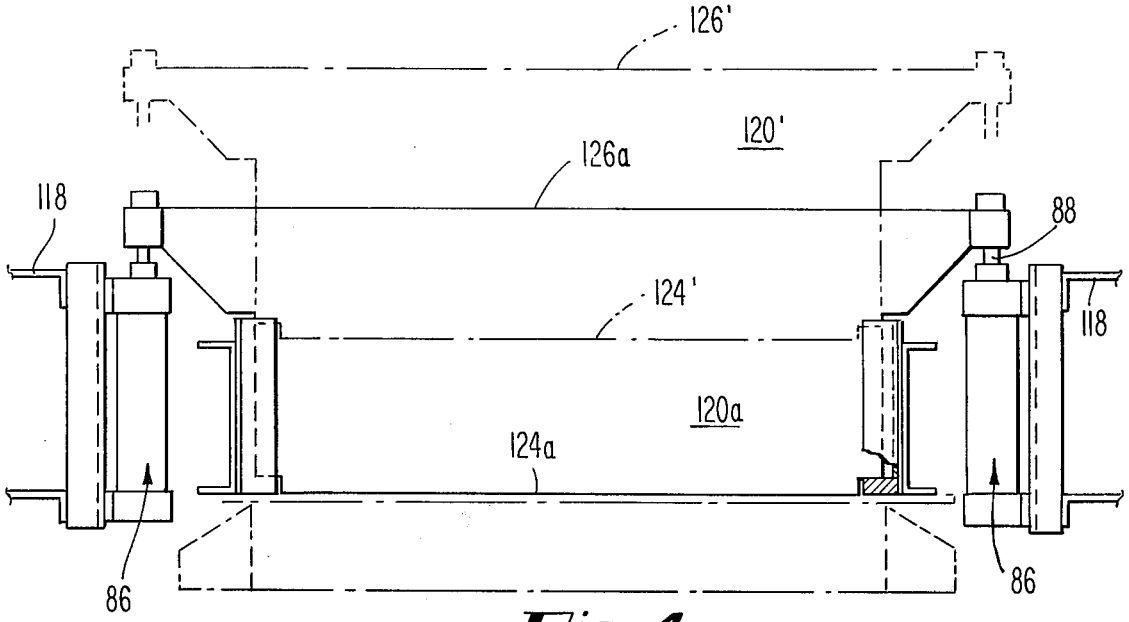
FIG. 4 is a partial cross-sectional view, taken along line 4—4 of FIG. 1.

The vertical movement of gates 120 is from the position shown in solid lines in FIG. 4 where the lower end of each gate 120 is just above the upper face of the slats of the conveyor to the position shown in phantom in FIG. 4 where the lower end 124' of each of the gates is raised approximately 12 inches so that it is above the upper edge of the cake as it advances through the machine of this invention. The shape of each of the gates 120, with a rectangular portion and a trapezoidal portion, is to permit the rectangular portion to form, together with the sides 100 and 110, a closed confined chamber in which the cake can be compressed while the trapezoidal portion allows the cylinders to be mounted external to the sides 100 and 110.

The hydraulic cylinders 80 and 90, which advance and retract the sides, only index approximately one inch, and move inwardly when the body of material has been advanced and is ready to be pressed, and retract one inch as the platens are raising and the press cake is advancing to the next position. As disclosed above, the platens may desirably be tapered approximately ¼ inch, with the wider end the downstream end, in order to facilitate the separation of the platens from the press cake and the advancing of the press cake. If the platens are untapered, it is particularly desirable to allow the side sections 100 and 110 to withdraw 1 inch from the press cake in order to facilitate downstream indexing of the press cake.

Figure 8:
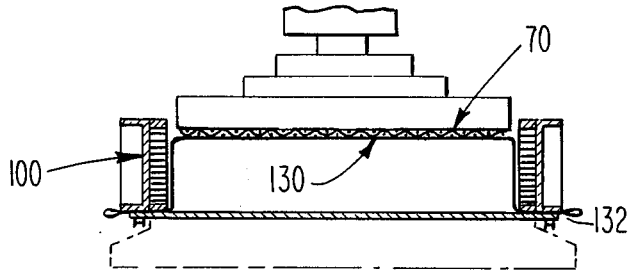
FIG. 8 is a partial cross-sectional view of the apparatus of the invention, similar to FIG. 3, showing a modification in which a press cloth is used in the press area to contain the cake.

An embodiment of the invention involving a modification is shown in FIG. 8, in which a press cloth 130 is used, within the chamber formed by the conveyor 36, the platens 52 and 56, gates 120 and the respective side sections 100 and 110 to form a closed package for the cake being pressed. In the embodiment shown in FIG. 8, there is a separate press cloth at each of the two platens which extends below the respective side sections 100 and 110 and its ends 132 are fastened thereto by the use of a suitable metal plate and metal screws or bolts. The upper portion of each press cloth may also be fastened to its corresponding platen by the use of a square metal frame, screwed at one end to the platen and over which the upper portion of the press cloth slides. Accordingly, as seen in FIG. 8, the cloth U-shaped envelope 130 may be formed to contain the press cake and to assist in preventing any of the press cake from being expressed through the screens 134 which cover the respective side sections 100 and 110. The press cloth is formed of a conventional material which is well known in the art.

Briefly, then, the operation of the press machine of this invention is as follows: The conveyor 36 is driven, by motor 42, at a linear speed of, for example, about 204 inches per minute. It is to be noted that the drive of the conveyor 36, is discontinuous, in a manner well-known in the art, since the conveyor 36 is not driven during the period when the platens are compressing the material being dejuiced, deoiled or dewatered. Accordingly, the motor is provided with suitable and well-known controls, to drive it at the 204 inches per minute rate, in 36 inch increments. The 36 inch increments are utilized with a 34 inch platen, in order to account for the two inch width of the gates.

The machine is stationary during a period of time which is the period of downward movement of the platens. The platens are supplied from a single hydraulic source and compress at the same time.

At the input end of the machine, the fruit or other material to be deliquified is introduced from a hopper, in a manner well-known in the art, into the basket 50.

The machine is driven incrementally, at a machine speed of about 204 inches per minute, in 36 inch increments (assuming the platens to be 34 inches long) and, in a desired embodiment of the invention, apples having a total bed height of up to twelve inches enter the first platen. In the first platen area, the gates 120*a* and 120 *b* are lowered after the mass to be deliquified has been properly positioned by conveyor 36 and the side sections 100 are moved inwardly. The gates 120*a* and 120*b* and side sections 100 form a rigid enclosure which contains the mass being pressed, prevents expulsion of pulp and allows high recovery of juice (or other liquid) from the material being compressed.

At the same time that gates 120*a* and 120*b* are being lowered and sides 100 are indexed inwardly for the low pressure platen compression, gate 120*c* and sides 110 are being lowered for the high pressure platen compression. Gates 120*b* and 120*c* and sides 110 form a rigid enclosure for the press cake in the high pressure platen area to allow recovery of up to about an additional ten percent of recoverable liquid from the material being compressed.

After the press cake exits the platen sections, the cake falls away from the conveyor 36 as the conveyor changes direction at the downstream end by virtue of its own weight. The cake falls into a suitable conveyor or receptacle, where the cake is taken for disposal or for such uses as incorporation in animal feed, fertilizer or the like.

When the material being compressed is beneath the platen 52, for example, gates 120*a*, 120*b* and 120*c* will be lowered to the position shown in FIG. 2 where they rest with their lower edges 124 on slats 38 of conveyor 36. At the same time that the gates are being lowered, the respective pairs of sides 100 and 110 are being moved inwardly by the hydraulic action of hydraulic assemblies 80 and 90. When the gates and sides have come to the right position the respective hydraulic cylinders 60 which operate platens 52 and 56 descend and compress the mash contained within the enclosure formed by each opposing pair of gates and sides and the underlying slats of the conveyor 36. The juice which is expressed during the compressive portion of the operation exits the enclosed area through the spaces between slats of the conveyor and between the slats of the side sections 100 and 110. The juice may also be expressed by running through the respective sets of grooves 62 and 66 in platens 52 and 56 and flowing from the groove through the slats which form the side sections 100 and 110. Juice which is released at the bottom of the press cake passes through the spaces between slats. The juice flows between the slats onto table 72, and when it overflows the edges of table 72, it is collected in the troughs 74, from which it is piped into suitable storage receptacles for further processing.

After the compression step is completed, platens 52 and 56 are raised, gates 120*a*, 120*b* and 120*c* are raised, and side sections 100 and 110 are indexed outwardly. The conveyor 36 then indexes through a 36 inch increment to the next position for compression and the cycle is repeated by the lowering of the gates 120, the inward indexing of sides 100 and 110 and the lowering of the platens.

The apparatus and process of this invention can be used for a wide variety of fruits, herbs, vegetables, oil seeds, sludges and other materials to be deliquified. Also, the particular conditions of any type of material can vary widely; for example, apples to be deliquified can be of different species, can be under-ripe, proper ripeness or over-ripe, or can be partially deliquified (as by centrifugal dejuicing) prior to entering the machine. All of these factors will determine the pressures used in the platen stages, the initial height of material fed to the platen stages, the degree of vertical movement of each platen, the size of the press cake formed at each stage, the spacing of the slats forming the sides 100 and 110, the mesh size of screens 70 and 134 and the characteristics of press cloth 130. All of these variables are well within the expertise of the skilled artisan in the field and are not part of this invention. Thus, if seed oils are being expressed, pressures of up to 3,000 p.s.i. at the high pressure platen would be necessary, but if apples are being dejuiced pressures of up to 300 or 400 p.s.i. would be appropriate. However, in any event the apparatus and process of this invention permit the compression of a much thicker initial feed level of material to be deliquified, with good efficiency of recovery of juice or other liquid, thereby making this invention a substantial improvement over prior art processes.

As the material being deliquified advances from the lower pressure platen stage (or stages) to the higher pressure platen stage (or stages) the cake is compressed, expressing more juice or other liquid and reducing the height of the cake. The number of compressions through which the material goes may be varied from one to a plurality of stages within the scope of this invention, although two stages are preferred.

The apparatus of this invention is highly automated and allows efficient production without excessive use of manual labor. The details necessary to achieve the automated operation of the machine are within the purview of a skilled artisan and form no part of this invention.

The process of this invention comprising the dewatering, deoiling or dejuicing of a compressible material by confining the material within a fixed shape by rigid sides, at least some of which have substantial porosity to permit the expression of liquid, the material being rigidly supported at the bottom and compressed by a rigid member at the top. Thus, in the process of this invention, material to be deliquified is transported to a platen section, front and back gates are lowered and sides are indexed inwardly to confine the press cake. The material is thereby rigidly supported on all of its sides and on its bottom by a permeable conveyor member whereby lowering the pressure platen will express liquid through the permeable sides and conveyor to a suitable collecting means without expressing any substantial part of the solid or semi-solid residue which forms the filter cake and is desired to be kept intact in the filter cake. As noted above, it may be desired to make the sides 110 impermeable, so that liquid in the high pressure platen section exits only through the spaces between slats of conveyor 36 and at the edges of the conveyor.

It is an important feature of this invention that the sides 100 ad 110 are movable to ease the pressure on the press cake to facilitate its feed and that the gates be raisable for the same purpose. In effect, the process requires the formation of a completely enclosed, substantially isolated container in each press section, comprising the sides, gates, conveyor and platens whereby the non-liquid material is retained within each container and wherein relatively little upstream or downstream seepage of liquid occurs because of the barrier formed by the gates associated with each platen.

It will be appreciated that the apparatus of the process of the invention is incorporated into a relatively conventional type of fruit press. Therefore, those characteristics of the invention which are conventional in character may be substantially varied, as may be the fruit or other material used in an invention, without departing from the spirit and scope of the invention.

What is claimed is:

1. In an apparatus for deliquifying compressible material comprising a frame, at least one vertically operable hydraulic cylinder dependingly mounted on said frame and having a depending platen, with opposing sides and opposing ends, the improvement comprising:

a. A rigid table beneath said platen;
b. A permeable endless conveyor having a surface overlying said table;
c. Rigid, permeable side means, one on either side of said platen, and substantially coextensive therewith and comprising a plurality of vertically spaced slats, each of said side means having an inner face;
d. Screen means substantially covering the inner face of each of said sides;
e. Indexing means mounted to said frame and each of said sides to index said sides toward and away from each other;
f. Rigid, vertically extending restraining means, one at either end on said platen and transverse to said side means and substantially coextensive with said platen;
g. Means vertically movably mounting each of said restraining means;
h. Said conveyor means, side means, restraining means and platen when brought together forming a substantially sealed rigid container within which said mass may be compressed to release juice substantially only through said side means and said conveyor means while maintaining the non-liquid portion of said mass in single compacted form.

2. Apparatus as set forth in claim 1, wherein said side means comprises a multiplicity of vertically spaced slats of rectangular cross section.

3. Apparatus as set forth in claim 2, wherein said spacing between said slats increases in a vertical direction, so that the slats proximate the conveyor are more closely spaced than the slats distant from the conveyor.

4. Apparatus as set forth in claim 1, including at least two platens, a pair of side means mounted on either side of each platen, a single restraining means mounted between the platens and a single restraining means associated with each platen and opposed to the restraining means between the platens.

5. Apparatus as set forth in claim 1, wherein said platen has a lower face and defines a plurality of transversely extending grooves across the entirety of its lower face and a screen fastened to said lower face and overlying said grooves.

6. Apparatus as set forth in claim 1, including an inverted U-shaped press cloth fastened at its lower ends proximate said side means and at its upper end to said platen.

7. Apparatus as set forth in claim 1, wherein said conveyor comprises a plurality of transversely extending slats of trapezoidal cross-section in the direction of machine feed and spaced apart at their upper faces about 1/16 inch.

8. An apparatus for deliquifying compressible materials comprising:

a. A frame;
b. At least two square platens;
c. Indexing means mounted on said frame mounting said platens for vertical indexing movement;
d. An endless conveyor mounted on said frame beneath said platens and comprising a plurality of slats closely spaced so that liquids but not solids will readily pass therebetween;
e. A collecting table rigidly supporting said conveyor;
f. A pair of parallel sides mounted on each side of each platen comprising a plurality of vertically spaced slats;
g. Screen means covering the inner faces of each of said sides;
h. A rigid, substantially rectangular solid gate mounted between the ends of each pair of sides, a single gate being located between each pair of platens;
i. Indexing means mounted to said frame and each of said sides to index said sides toward and away from each other;

j. Indexing means mounted to said frame and each of said gates to index said gates from a first position wherein each gate is substantially touching said conveyor to a second position wherein each gate is substantially above said conveyor;

k. Said sides in their inwardly indexed position and said gates in said lowered position forming with said conveyor and said platens in their lowered position a plurality of substantially sealed compartments allowing substantially only escape of liquid through said sides and said conveyor to said table.

9. Apparatus as set forth in claim 8, wherein the slats of said sides are more closely spaced proximate said conveyor than distant from said conveyor.

* * * * *